US005386985A

United States Patent [19]

Paris

[11] Patent Number: 5,386,985

[45] Date of Patent: Feb. 7, 1995

[54] INSTANT BINGO GAME CARD

[75] Inventor: Michel Paris, St-Léonard, Canada

[73] Assignee: Les Technologies Babn Inc., Montréal, Canada

[21] Appl. No.: 212,853

[22] Filed: Mar. 15, 1994

[51] Int. Cl.[6] ..... A63F 3/06

[52] U.S. Cl. ..... 273/269; 273/139; 283/101

[58] Field of Search ..... 273/269, 138 R, 139, 273/148 R; 283/901, 903, 100–102

[56] References Cited

U.S. PATENT DOCUMENTS 4,212,468 7/1980 Knott ..... 273/269
5,074,566 12/1991 Desbiens ..... 273/269
5,193,815 3/1993 Pollard ..... 273/269

*Primary Examiner*—Benjamin H. Layno
*Attorney, Agent, or Firm*—Robic

[57] ABSTRACT

Disclosed is an instant game card, preferably of the BINGO type, having a substrate onto which is printed a series of playing numbers. An unscratchable translucent varnish is applied onto the substrate and covers the playing numbers. A scratchable rub-off coating is applied onto the varnish, in such a manner as to surround the playing numbers without hiding the same. In use, when playing numbers are called, scratching of the scratchable rub-off coating surrounding each playing number that correspond to one of the called numbers, allow a player to visualize the position of the called playing numbers on his or her card.

16 Claims, 3 Drawing Sheets

INSTANT BINGO GAME CARD

BACKGROUND OF THE INVENTION a) Field of the Invention

The present invention relates to an improved instant game card and more particularly but not exclusively an instant bingo game card.

b) Brief Description of the Related Art

Known in the art is U.S. Pat. No. 5,074,566 (DESBIENS), which describes a two level scratch game. This scratch game consists of a substrate on which is printed a first grid of numbers, and which is covered by a scratchable rub-off coating hiding the numbers of the first grid. A second grid, identical in size and containing the very same numbers as the first one is printed on the rub-off coating. This scratch game requires a lot of rub-off coating to cover all the first grid, and requires printing of the playing numbers twice. Moreover, the first and second printings need to be perfectly synchronised to avoid any discrepancies between the visible and hidden grids.

Also known in the art is U.S. Pat. No. 5,193,815 (POLLARD) which describes an instant bingo game card comprising a substrate on which is printed one or more grids of numbers. Each grid is covered by a translucent coat of a scratchable material which is pigmented so as to modify the appearance of the underlying color of the substrate in the area where is printed the grid. This instant bingo game card requires a lot of scratchable material to cover the grids, and the contrast between the scratched and unscratched numbers is limited to the shade of the translucent coat.

Further known in the art is U.S. Pat. No. 4,212,468 (KNOTT) which describes a pressure sensitive game apparatus. This apparatus consists of a sheet of flexible translucent material having the symbol pattern corresponding to a bingo card overlying, and a substantially rigid backing member attached to the translucent sheet. The backing member is coated with a pigmented material and a pressure sensitive releasable adhesive material. Pressure on the translucent sheet urges it into contact with the adhesive material and causes the pigmentation to show through the translucent sheet. This apparatus requires several manipulations of the translucent sheet and the backing member. Moreover, when pressure is applied on the apparatus because of a bad movement, the pigmentation of the area pressed shows through the translucent sheet, causing an error.

Also known in the art are bingo game lottery tickets that have been offered for a while by the Iowa Lottery. The ticket includes a caller's card covered by a thick layer of a rub-off coating, and a plurality of playing cards. Beside each playing number of each playing card, a small dot is printed in red and covered by a small patch of rub-off coating. In use, the player scratches the rub-off coating covering the caller's card and scratches the patch of rub-off coating adjacent to each playing number corresponding to the uncovered numbers of the caller's card, so as to mark the same. The patch of rub-off coating provided beside each playing number is quite small and often difficult to scratch without scratching the surrounding patches.

SUMMARY OF THE INVENTION

It is an object of the present invention to provide an instant game card that requires a smaller quantity of scratchable rub-off coating than the similar cards presently known to the Applicant, while offering a marked contrast between the scratched and the unscratched numbers to better visualize the called numbers.

According to the present invention, the above object is achieved with an instant game card according to the invention, which comprises:

- a substrate having printed thereon at least one series of playing numbers;
- an unscratchable translucent varnish applied onto the substrate so as to surround at least each of the playing numbers; and
- a scratchable rub-off coating applied onto the varnish in such a manner as to surround each of the playing numbers without hiding the same;

whereby, in use, when numbers are called, scratching of the scratchable rub-off coating that surrounds the playing numbers that correspond to those that are called, allows a player to visualize the position of the playing numbers that were so called in each of said series.

According to a preferred embodiment of the present invention, the above instant game card is preferably an instant bingo game card which comprises:

- a substrate having printed thereon at least one matrix filled with playing numbers representing a bingo game;
- an unscratchable translucent varnish applied onto the substrate so as to cover each of the at least one matrix; and
- a scratchable rub-off coating applied onto the varnish in such a manner as to surround each of the playing numbers of each of the at least one matrix without hiding the same;

whereby, in use, when numbers are called, scratching of the scratchable rub-off coating surrounding the playing numbers corresponding to those that are called, allow a player to visualize the position of the playing numbers that were so called on each of the at least one matrix.

As can be appreciated, the playing numbers have to be printed only once and are clearly visible since they are not covered by any rub-off coating, translucent or not. Moreover, it is easy to identify the called playing numbers by scratching the rub-off surrounding of the called playing numbers.

BRIEF DESCRIPTION OF THE DRAWINGS

In order to impart full understanding of the manner in which this object and other objects are attained in accordance with the present invention, preferred embodiments thereof will be described hereinafter with reference to the accompanying drawings wherein.

In the following description and in the drawings, the same numerals will refer to the same elements.

DESCRIPTION OF PREFERRED EMBODIMENTS

Figure 1:
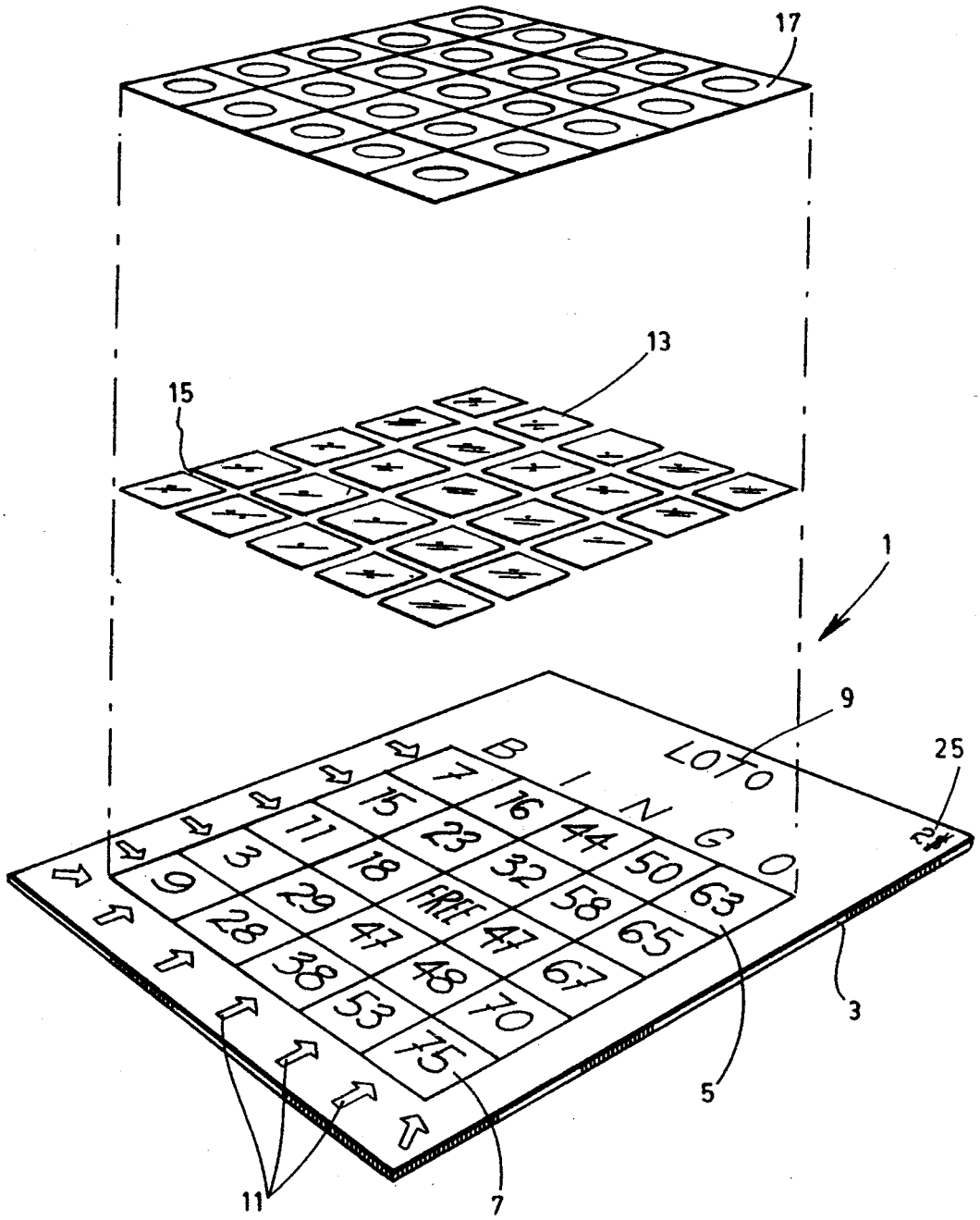
FIG. 1 is ah exploded perspective view of an instant bingo game card according to a first embodiment of the invention.

FIG. 1 shows an instant bingo game card 1 according to the invention. This instant bingo game card 1 comprises a substrate 3 in the form of a card, onto which is printed one matrix 5 "shaped" as a bingo game. Of course, several matrices 5 could be printed onto the substrate 3, if desired.

The matrix 5 preferably has five rows of five playing numbers 7 ranging from 1 to 75, distributed over five columns. Each column has a specific range of numbers such as, for example, nos. 1 to 15 in column 1, nos. 16 to 30 in column 2, etc. As in bingo cards, each column may be identified by a letter printed above the column, for example "B" above the first column, "I" above the second column, and so on, with the letters of the word "BINGO".

To identify the instant bingo game card 1, a name 9 is printed on the substrate 3, as for example "LOTO BINGO". In order to be more visible, the name 9 is preferably printed in the upper section of the substrate 3. Beside the name 9, a ticket price 25 may also be printed on the substrate 3. Another type of printings 11 may be used to describe each of the winning combinations of playing numbers 7 that may be called during a game. These printings 11 are printed on the substrate 3 beside the matrix 5. The winning combinations may, for example be one of the rows of the matrix 5, one of the columns of the matrix, two crossing diagonals of the matrix or four corners of the matrix. The printings 11 may further describe prizes that are won for each of the winning combinations.

An unscratchable translucent varnish 13 is applied onto the printed substrate 3. The varnish 13 may cover all the printed substrate 3, but is preferably applied only over the playing numbers 7. If these numbers are located in boxes square in shape, then each playing number 7 may be covered by a square of varnish. Preferably, the varnish squares are sized in such a manner as to be spaced from each other, and to leave bands 15 of substrate between the varnished boxes containing the playing numbers 7.

A scratchable rub-off coating 17 is applied onto the varnish 13 covering the playing numbers 7. In accordance with the invention, the scratchable rub-off coating 17 surrounds each of the playing numbers 7 without hiding them. The scratchable rub-off coating 17 is applied directly onto the substrate 3 over the bands 15 to cover them, as shown on FIG. 2. When a player scratches the rub-off coating 17 surrounding the playing numbers 7, the rub-off coating 17 beneath which there is varnish 13 peels away, while the rub-off coating 17 applied onto the unvarnished substrate 3 stays in place and form partitioning lines 21 between the scratched playing numbers 4.

In a bingo game, when the playing numbers 7 are called, the player has to scratch the scratchable rub-off coating 17 surrounding the playing numbers 7, corresponding to those that are called. The scratched rub-off coating 17 allows the player to see the substrate 3 surrounding the scratched playing numbers 7, which is preferably of a contrasted color with respect to the unscratched playing numbers 7. So, scratching the surrounding of the playing numbers 7 allow the player to clearly visualize the position of the called numbers 7 in the matrix 5.

Figure 2:
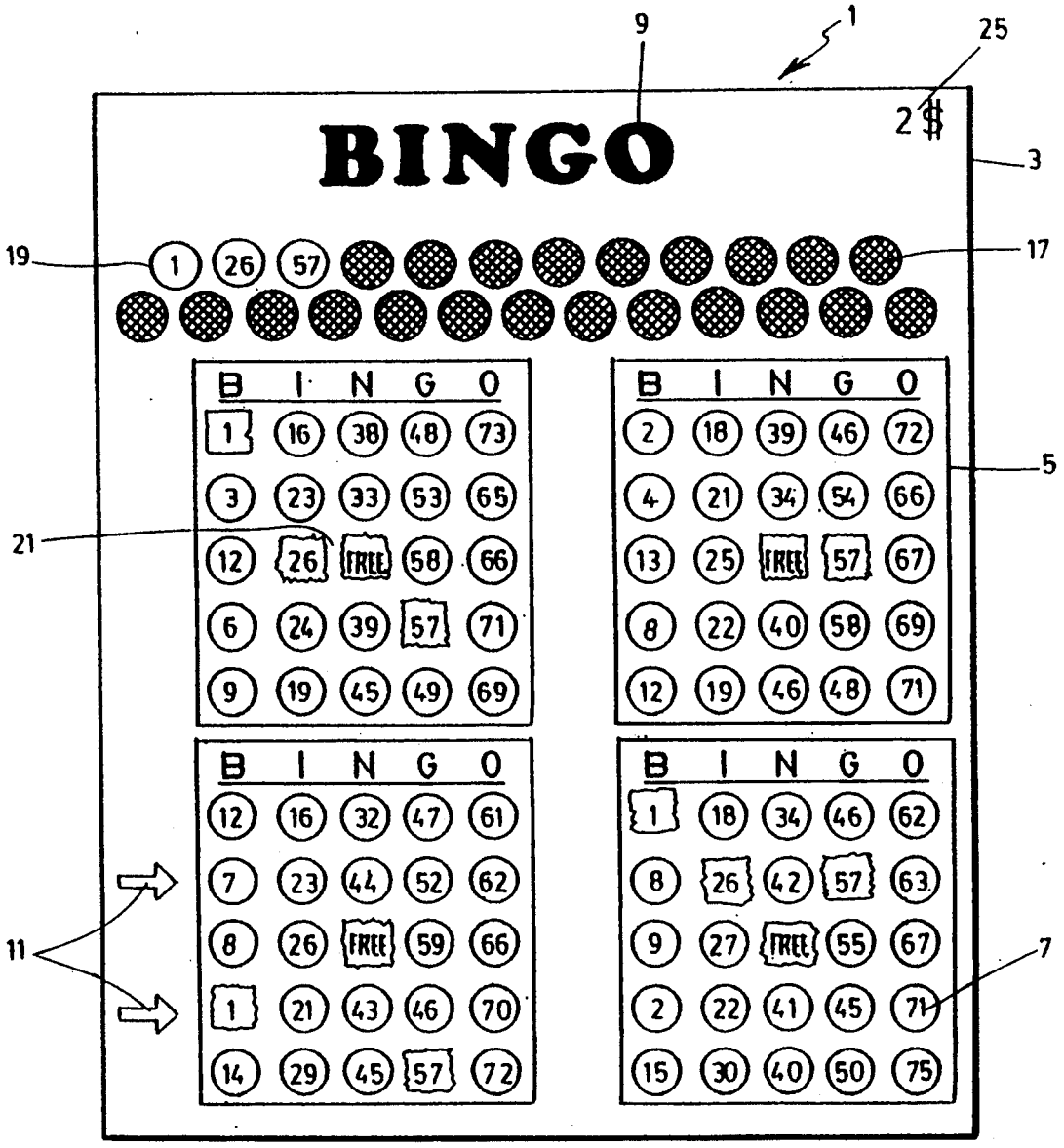
FIG. 2 is a top plan view of an instant bingo game card according to a second embodiment of the invention.

The instant bingo game card 1 according to the second embodiment of the invention, as shown on FIG. 2, further comprises caller's numbers 19 disposed in two lines. It is clear that the caller's numbers 19 could also be disposed along one line or more, or even in a grid. However the disposition of these caller's number in lines is preferred since it reduces the space occupied by the same on the substrate 3, and thus leaves more space for the matrix(ces) 5, which can be made bigger and thus easier to scratch.

To protect the caller's numbers 19 printed on the substrate 3, a layer of the unscratchable translucent varnish 13 is applied over them. The scratchable rub-off coating 17 or any other scratchable coating is then applied onto the varnish 13 in such a manner as to cover each of the caller's numbers 19.

In use, a player will scratch the rub-off coating 17 covering the caller's numbers 19 of this second embodiment of the invention, and scratch the rub-off coating 17 surrounding the playing numbers 7 corresponding to the caller's numbers 19. It will then be possible to visualize the position of the playing numbers 7 corresponding to the caller's numbers 19 on the matrix 5. It will also be possible to determine when the playing numbers 7 corresponding to the caller's numbers 19 form one of the winning combinations for which there is a prize to be won.

Figure 3:
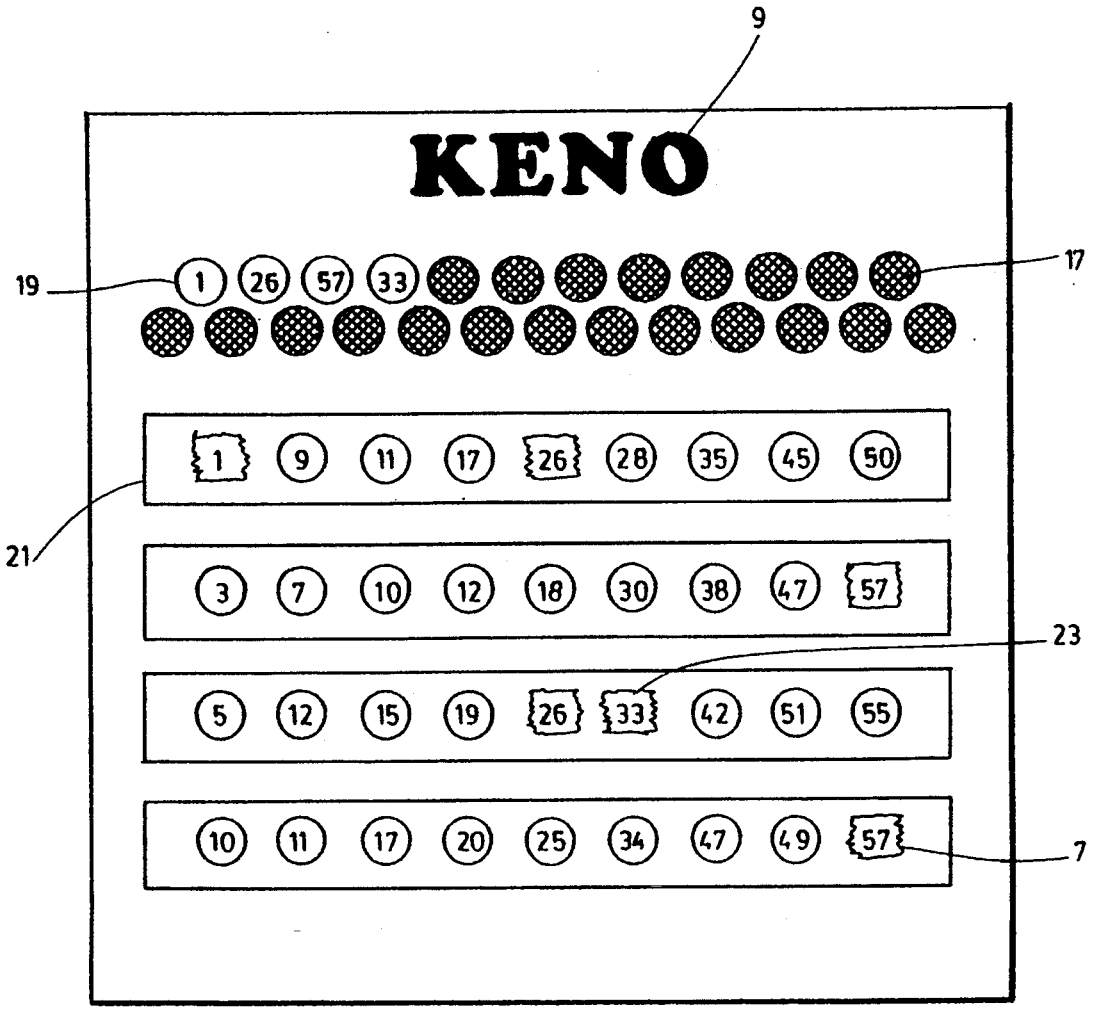
FIG. 3 is a top plan view of an instant game card according to a third embodiment of the present invention.

In accordance with a third embodiment of the invention, shown on FIG. 3, the instant game card is not of the BINGO type. It nevertheless comprises a substrate 3 onto which is printed several series 21 of playing numbers 7. Of course, one series 21 or more can be printed on the substrate 3. Preferably, each series 21 consists of a line of several playing numbers 7. Each of the playing numbers 7 is printed in a box 23. The name 9 of the game is printed onto the substrate 3, preferably in the upper section of it. Printings 11 describing each of the winning combinations are also printed on the substrate 3. The winning combinations are, for example, seven called numbers out of ten playing numbers 7 forming one series 21, and for each additional number called in a series 21, the prize gets bigger.

An unscratchable translucent varnish 13 is also applied onto the substrate 3, to cover each of the boxes 23. A scratchable rub-off coating 17 is then applied onto the varnish 13 in such a manner as to surround each of the playing numbers 7.

In use, a player will scratch the rub-off coating 17 surrounding the playing numbers 7 corresponding to those that are called. The scratched rub-off coating 17 will allow the player to visualize the number of called playing numbers 7 in each series 21, to determine whether his or her card 1 contains one or more winning combinations.

According to a variant of this third embodiment of the invention, the instant game card 1 further comprises caller's numbers 19 printed onto the substrate 3. The caller's numbers 19 are covered by the varnish 13, onto which is applied the rub-off coating 17 or any other scratchable coating, in such a manner as to hide the caller's numbers 19.

In use of this variant of the third embodiment, the player scratches the rub-off coating 17 covering the caller's numbers 19, and scratches the rub-off coating 17 surrounding the playing numbers 7 corresponding to the caller's numbers 19. It is then possible for the player to visualize the number of called playing numbers 7 in each series 21, and to determine if he won one of the prizes.

Although the present invention has been explained hereinabove by way of preferred embodiments thereof, it should be pointed out that any modifications to these preferred embodiments, within the scope of the appended claims, are not deemed to change or alter the nature and scope of the present invention.

I claim:

1. An instant game card comprising:

a substrate having printed thereon at least one series of playing numbers;

an unscratchable translucent varnish applied onto said substrate so as to surround at least each of said playing numbers; and a scratchable rub-off coating applied onto said varnish in such a manner as to surround each of said playing numbers without hiding the same;

whereby, in use, when numbers are called, scratching of said scratchable rub-off coating that surrounds the playing numbers that correspond to those that are called, allows a player to visualize the position of the playing numbers that were so called in each of said series.

2. An instant game card according to claim 1, further comprising caller's numbers printed onto said substrate and disposed in at least one line, each of said caller's numbers being covered with said unscratchable translucent varnish and being hidden by another scratchable rub-off coating applied onto said varnish.

3. An instant game card according to claim 2, further comprising a game name printed onto said substrate.

4. An instant game card according to claim 3, wherein each of said at least one series of playing numbers consists of a line of a plurality of said playing numbers.

5. An instant game card according to claim 4, further comprising printings on said substrate describing each winning combination of playing numbers that may be called.

6. An instant game card according to claim 5, wherein a prize is won when a given number of playing numbers are called, which belongs to one of said at least one series of playing numbers in line.

7. An instant bingo game card comprising:

a substrate having printed thereon at least one matrix filled with playing numbers representing a bingo game;

an unscratchable translucent varnish applied onto said substrate so as to cover each of said at least one matrix; and a scratchable rub-off coating applied onto said varnish in such a manner as to surround each of said playing numbers of each of said at least one matrix without hiding the same;

whereby, in use, when numbers are called, scratching of said scratchable rub-off coating surrounding the playing numbers corresponding to those that are called, allow a player to visualize the position of the playing numbers that were so called on each of said at least one matrix.

8. An instant bingo game card according to claim 7, further comprising caller's numbers printed onto said substrate and disposed in at least one line, each of said caller's numbers being covered with said unscratchable translucent varnish and being hidden by another scratchable rub-off coating applied onto said varnish.

9. An instant bingo game card according to claim 8, which comprises two of said at least one line.

10. An instant bingo game card according to claim 8, further comprising a game name printed onto said substrate.

11. An instant bingo game card according to claim 10, further comprising printings on said substrate describing each winning combination of playing numbers that may be called.

12. An instant bingo game card according to claim 11, wherein said each winning combination is a row of any one of said at least one matrix, a column of any one of said at least one matrix, two crossing diagonals of any one of said at least one matrix and four corners of any one of said at least one matrix.

13. An instant bingo game card according to claim 12, which comprises four of said at least one matrix.

14. An instant bingo game card according to claim 7, wherein said at least one matrix further comprises partitioning lines surrounding said playing numbers.

15. An instant bingo game card according to claim 14, wherein said partitioning lines consist of bands of said substrate that are not covered by said varnish, whereby the scratchable rub-off coating covering said bands cannot be scratched.

16. An instant bingo game card comprising:

a substrate having printed thereon:

a game name;

four matrices filled with playing numbers representing four bingo games;

caller's numbers disposed in at least two lines; and each winning combination that may be called;

an unscratchable translucent varnish applied over said matrices and said caller's numbers;

a scratchable rub-off coating applied onto said varnish in such a manner as to surround each of said playing numbers of each of said four matrices, without hiding the same, and to cover each of said caller's numbers;

whereby, in use, scratching of said rub-off coating covering said caller's numbers and scratching of said rub-off coating surrounding said playing numbers corresponding to said caller's numbers allow a player to visualize the position of the playing numbers corresponding to the caller's numbers on each of said four matrices, and to determine when the playing numbers corresponding to the caller's numbers on each of said four matrices form one of said winning combinations for which there is a prize to be won.

* * * * *